US005686217A

United States Patent [19]

Yoerger

[11] Patent Number: 5,686,217

[45] Date of Patent: Nov. 11, 1997

[54] CARRIER PARTICLES BEARING INSOLUBLE METAL SALT DEPOSITS

[75] Inventor: William Edward Yoerger, Rochester, N.Y.

[73] Assignee: Eastman Kodak Company, Rochester, N.Y.

[21] Appl. No.: 630,143

[22] Filed: Apr. 10, 1996

[51] Int. Cl.[6] ..... G03G 9/113

[52] U.S. Cl. ..... 430/108; 430/137; 428/404; 428/407

[58] Field of Search ..... 430/108, 137; 428/404

[56] References Cited

U.S. PATENT DOCUMENTS 4,726,994 2/1988 Yoerger ..... 428/403

4,737,435 4/1988 Yoerger ..... 430/137

5,411,832 5/1995 Yoerger ..... 430/108

FOREIGN PATENT DOCUMENTS 2-131250 5/1990 Japan ..... 430/108

*Primary Examiner*—Roland Martin

*Attorney, Agent, or Firm*—John R. Everett

[57] ABSTRACT

Carrier particles for use in negative electrostatographic developers wherein said particles bear, based on the weight of the carrier particles, from 0.1 to 2 weight percent of deposits selected from the group consisting of (a) strontium carbonate, (b) insoluble metal hydroxides, (c) an insoluble metal hydrated oxide, and (d) mixtures thereof; provided that when the said carrier particles bear a polymeric fluro-carbon coating the deposit is other than strontium carbonate.

14 Claims, No Drawings

CARRIER PARTICLES BEARING INSOLUBLE METAL SALT DEPOSITS

CROSS REFERENCE TO RELATED APPLICATION

Reference is made to and priority claimed from U.S. Provisional Application Ser. No. U.S. 60/002,041, filed 08 Aug. 1995, entitled CARRIER PARTICLES BEARING INSOLUBLE METAL SALT DEPOSITS.

FIELD OF THE INVENTION

The invention relates to carrier particles, a method for preparing the dry particles and electrostatographic developers.

BACKGROUND OF THE INVENTION

In electrostatography, image charge patterns are formed on a support and are developed by treatment with an electrostatographic developer containing marking particles which are attracted to the charge patterns. These particles are called toner particles or, collectively, toner. The image charge pattern, also referred to as an electrostatic latent image, is formed on an insulative surface of an electrostatographic element by any of a variety of methods. For example, the electrostatic latent image may be formed electrophotographically, by imagewise photo-induced dissipation of the strength of portions of an electrostatic field of uniform strength previously formed on the surface of an electrophotographic element comprising a photoconductive layer and an electrically conductive substrate. Alternatively, the electrostatic latent image may be formed by direct electrical formation of an electrostatic field pattern on a surface of a dielectric material.

One well-known type of electrostatographic developer comprises a dry mixture of toner particles and carrier particles. Developers of this type are employed in cascade and magnetic brush electrostatographic development processes. The toner particles and carrier particles differ triboelectrically, such that during mixing to form the developer, the toner particles acquire a charge of one polarity and the carrier particles acquire a charge of the opposite polarity. The opposite charges cause the toner particles to cling to the carrier particles. During development, the electrostatic forces of the latent image, sometimes in combination with an additional applied field, attract the toner particles. The toner particles are pulled away from the carrier particles and become electrostatically attached, in imagewise relation, to the latent image beating surface. The resultant toner image can then be fixed, by application of heat or other known methods, depending upon the nature of the toner image and the surface, or can be transferred to another surface and then fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface.

Toner particles in many dry, two-component electrostatographic developers include a charge control agent. The charge control agent desirably, provides a high uniform net electrical charge to toner particles without reducing the adhesion of the toner to paper or other medium. Positive charge control agents, materials which impart a positive charge to toner particles in a developer, have been widely used and a great many are described in the published patent literature. In contrast, choices are more limited with negative charge control agents and negatively charging toners.

Carrier particles comprise a core material with or without a polymer coating. Polymer coated carrier particles coatings can serve a number of known purposes. One such purpose can be to aid the developer to meet the electrostatic force requirements mentioned above by shifting the carrier particles to a position in the triboelectric series different from that of the uncoated carrier particles core material, in order to adjust the degree of triboelectric charging of both the carrier particles and the toner particles. A further purpose can be to alter the electrical resistance of the carrier particles. All of these, and even more, purposes are well known in the art for polymer coated carrier particles coatings.

While such carrier particles coatings can serve all of the above-noted purposes well, in some cases the coatings do not adequately serve some or all of these purposes simultaneously. For example, in some developer compositions, polymeric fluorohydrocarbon carrier particles coatings can serve many of the above-noted purposes well, but, depending upon the nature of the toner particles and carrier particles core material desired to be included in the developer, such carrier particles coatings can cause the developer to acquire a triboelectric charge that is too high for optimum developer performance; that is, the electrostatic latent image has difficulty pulling the toner particles away from the carrier particles.

U.S. Pat. Nos. 4,737,435 and 4,726,994 to Yoerger, disclose a method of dehydrofluorinating a fluorohydrocarbon carrier particles coating by contacting the coated carrier particles with (1) a basic solution or (2) a basic solution containing an oxidizing agent. The resulting change in chemical structure has the effect of repositioning the carrier particles triboelectrically. Examples in both U.S. Pat. Nos 4,737,435 and 4,726,994 are directed to positively charging developer (referring to the charge on the toner particles), that is, developer which contains negatively charging carrier particles. Also treatment with base and oxidizer may result in a toner charge that is excessively high.

U.S. Pat. No. 5,411,832 discloses a method in which polyfluorohydrocarbon coated carrier particles is contacted with a basic solution including a reducing agent for the particles. The basic solution optionally includes an oxidizing agent for the particles. In this method strontium carbonate is formed on the surface of the carrier particles. Improved carrier particles and developers are produced by the method of the invention. The problem is that any improvements are dependent upon the presence of the polyfluorohydrocarbon coating for a source of carbonate to form the deposit. Methods to improve other polymer coated or uncoated carrier particles are needed, especially to provide improved negative electrostatographic developers.

There is a continuing need for negatively charging developers (developers in which toner charges negatively and carrier particles positively). The methods of the above mentioned patents provide beneficial results when applied to negatively charging developers, however, those results are not optimal in all circumstances.

SUMMARY OF THE INVENTION

The invention, in its broader aspects, provides carrier particles for use in negative electrostatographic developers wherein said particles bear, based on the weight of the carrier particles, from 0.1 to 2 weight percent of deposits selected from the group consisting of (a) strontium carbonate, (b) insoluble metal hydroxides, (c) an insoluble metal hydrated oxide, and (d) mixtures thereof; provided that when the said carrier particles bear a polymeric fluorocarbon coating the deposit is other than strontium carbonate.

The carrier particles are useful in improving the charging rate and reducing throw off of negative electrostatographic developers also provided by this invention.

The carrier particles result from a novel method of modifying the triboelectric charging propensity of polymer coated and uncoated carrier particles. The method comprises the steps of:

(A) providing a carrier particles that is uncoated or polymer coated;

(B) mixing the carrier particles with an oxidizing agent and either (i) an aqueous basic solution or (ii) an aqueous solution containing from 0.1 to 5.0 weight percent of a soluble acidic metal salt, based on the weight of the carrier particles to form a mixture; and (C) contacting the mixture with the solution, (i) or (ii), not used in step (B) thereby causing a precipitate of an insoluble salt to deposit on the carrier particles wherein the insoluble salt is (a) strontium carbonate;

(b) insoluble metal hydroxides;

(c) insoluble metal hydrated oxides; or (d) a mixture of two or more of (a), (b) and (c).

DETAILS OF THE INVENTION

The carrier particles provided by this invention bear a deposit of from 0.1 to 2 weight percent, based on the weight of the carrier particles, of (1) strontium carbonate, (2) insoluble metal hydroxides, (3) an insoluble metal hydrated oxides or (4) mixture of such deposits. The carrier particle is coated or uncoated. Outside the scope of the present invention are carrier particles bearing a polymeric fluorocarbon coating and any strontium carbonate deposit.

Examples of uncoated particles include: iron particles such as porous iron particles having oxidized surfaces, steel particles, and other "hard" or "soft" ferromagnetic materials such as gamma ferric oxides or ferrites, such as ferrites of barium, strontium, lead, magnesium, nickel, copper, cobalt, or aluminum. See, for example, U.S. Pat. Nos. 4,042,518; 4,478,925; and 4,546,060.

Any of the above uncoated carrier particles may be coated with polymers such as silicone resin; acrylic polymers such as poly(methylmethacrylate); and vinyl polymers, such as polystyrene and combinations of materials such as styrene/methylmethacrylate and fluorohydrocarbon polymers such as poly(vinylidene fluoride) or poly(vinylidene fluoride-co-tetrafluoroethylene). See, for example, U.S. Pat. Nos. 4,546,060; 4,478,925; 4,076,857; and 3,970,571. polyfluorocarbons (poly(vinylidene fluoride) and copolymers of poly (vinylidene fluoride) and polytetrafluoroethylene, trifluoroethylene or chlorotrifluoroethylene, and mixtures of these). See for example, U.S. Pat. Nos. 4,545,060; 4,478,925; 4,076,857; and 3,970,571. The term "coated" should not be understood to suggest or imply that the surface of the carrier cores is completely covered with a uniform layer of polyfluorohydrocarbon.

The polymers are coated on the carriers at about 0.001 percent to about 5 percent weight/weight basis, or preferably, on a 0.5 percent weight/weight basis. Coating percentages outside this range may be utilized, however, care must be taken to avoid covering an excessive portion of the surface of the particles. A suitable coating percentage can be determined by simple experimentation.

The method of the invention is believed to be applicable to any known or new carrier particles, coated or uncoated, except polymer coatings that are severely degraded by base. In the method untreated polymer coated or uncoated carrier particles are subjected to an oxidizing agent and a soluble acidic metal salt in a basic solution. After subjection to this process the carrier particles have been "treated". That is the treated particles bear a deposit of an insoluble metal salt according to the invention and untreated particles do not.

The term "oxidizing agent" as used herein refer to materials which would be regarded as such, in ordinary chemical usage. The oxidizing agents can be considered in relation to the untreated carrier particles; that is, the oxidizing agent should, at least theoretically oxidize one or more components of the used ion the method including untreated carrier particles.

In making the carrier particles of the invention, untreated carrier particles are brought into contact with oxidizing agent, base and acidic metal salt by straight forward mixing the carrier particles with the ingredients. However certain salts, such as those of Mg, La and Ni readily precipitate in the presence of base. In these situations it is essential that the carrier particles be present when base is present, or that the carrier particles are added to the metal salt in solution prior to addition of base. This is important to insure that precipitants deposit on carrier particles surfaces and not precipitate out of solution before carrier particles are added to the mixture. The mixture of carrier particles and other reactants are continuously stirred to insure complete reaction.

Useful oxidizing agents are selected from peroxydisulfate ($S_2O_8^{2-}$) and peroxymonosulfate ($SO_5^{2-}$) (referred to herein collectively as "persulfate").

Any basic material or combination of basic materials can be employed in the method. For example, good results have been achieved with metal hydroxides, such as KOH and NaOH; ammonium hydroxides, such as $NH_4OH$ and $(CH_3)_4NOH.5H_2O$; amine salts such as $NaNH_2$, and other bases, such as $Na_2CO_3$.

Examples of useful soluble acidic salts are presented in tables 1–3, infra. The concentration of salt used is in the method is from about 0.1 to about 5 weight percent based on the weight of the uncoated carrier particles being treated.

The term "charge control" refers to a propensity of a toner addenda to modify the triboelectric charging properties of the resulting toner.

The extent of reaction of the untreated carrier particles can be varied by varying the parameters of the process. For example, degree of reaction and the thickness or depth of the coating effected (these are different parameters) can be increased somewhat by increasing the concentration of base and oxidizing agent in the treating solution, by lengthening time of treatment, or by raising the temperature of the reactants. Altering the degree of reaction, and, to some extent, the depth thereof, can alter the degree of change in triboelectric charging propensity of a coated carrier particles or the useful life. The optimum time, temperature, and concentrations to be used in any instance will depend upon the particular base, oxidizing agent and untreated particles involved and the particular triboelectric charging propensity desired to be effected.

Concentrations of base, and oxidizing agent, from a trace to about 15 percent by weight of total solution, were found to yield beneficial effects, depending upon the particular base, oxidizing agent and untreated carrier particles involved.

Carrier particles of the present invention can be used in combination with a wide variety of toner particles known in the art to be useful in combination with carrier particles and with any of the sizes and size ratios known to be useful for such particles, to serve as dry electrostatographic developers in any of the well known dry electroscopic development schemes, e.g., cascaded development or magnetic brush development.

In a particular embodiment, the developer provided by this invention contains from about 1 to about 20 percent by weight of toner and from about 80 to about 99 percent by weight of carrier of the invention. Usually, carrier particles are larger than toner particles. Conventional carrier particles have a particle size of from about 5 to about 1200 micrometers and are generally from 20 to 200 micrometers. Typically, and illustratively, the toner particles have an average diameter between about 2.0 micrometers and about 100 micrometers, and desirably have an average diameter in the range of from about 5.0 micrometers and 30 micrometers for currently used electrostatographic processes.

It is a characteristic of the developer of a preferred embodiment of the invention that the charge development is uniform, that is, that substantially all of the individual toner particles exhibit a triboelectric charge of the same sign with respect to a given carrier. Toner in a preferred embodiment of the invention achieves and maintains a negative charge. It is also preferred that toner throw-off be minimized. The term "toner throw-off" refers to the amount of toner powder thrown out of a developer mix as it is mechanically agitated, for example, within a development apparatus. Throw-off can cause unwanted background development and general contamination problems.

The properties of the thermoplastic polymers employed as the toner matrix phase in the present invention can vary widely. Typically, and preferably, amorphous toner polymers having a glass transition temperature in the range of about 50° C. to about 120° C. or blends of substantially amorphous polymers with substantially crystalline polymers having a melting temperature in the range of about 65° C. to about 200° C. are utilized in the present invention. Preferably, such polymers have a number average molecular weight in the range of about 1000 to about 500,000. The weight average of molecular weight can vary, but preferably is in the range of about $2\times10^3$ to about $1\times10^6$. Preferably, the thermoplastic polymers used in the practice of this invention are substantially amorphous. However, as indicated above, mixtures of polymers can be employed, if desired, such as mixtures of substantially amorphous polymers with substantially crystalline polymers.

Polymers useful as binders in the toner of the invention include styrenic/acrylic copolymers. In general, preferred styrenic/acrylic copolymers have a glass transition temperature in the range of about 50° C. to about 100° C. In a particular embodiment of the invention, the resin is a copolymer of styrenic and butyl acrylate, crosslinked with divinyl benzene; produced in a suspension or emulsion polymerization process. An initiator and, optional, a chain transfer agent are used in the synthesis. The ratio of styrene to butyl acrylate is in the range of from 90:10 to 60:40 and the divinyl benzene is used at a level of 0.1 to 1.0 weight percent.

The toner can include charge control agent in an amount effective to modify, and preferably, improve the properties of the toner. It is preferred that a charge control agent improve the charging characteristics of a toner, so the toner quickly charges to a negative value having a relatively large absolute magnitude and then maintains about the same level of charge. In a preferred embodiment of the invention, the negative charge control agent used is a metal(1-),bis{(2-hydroxyphenyl)azo}-2-hydroxynaphthyl(2-)}compound. Specific examples of such compounds include chromate(1-),bis{1-{(5-chloro-2-hydroxyphenyl)azo}-2-naphthalenolato(2-)}, hydrogen, which has the formula:

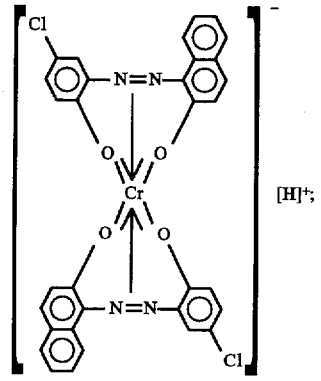

and ferrate(1-),bis{4-{(5-chloro-2-hydroxyphenyl)azo}-3-hydroxy-N-phenyl-2-naphthalenecarboxamidato(2-)}, ammonium, sodium, and hydrogen, which has the formula:

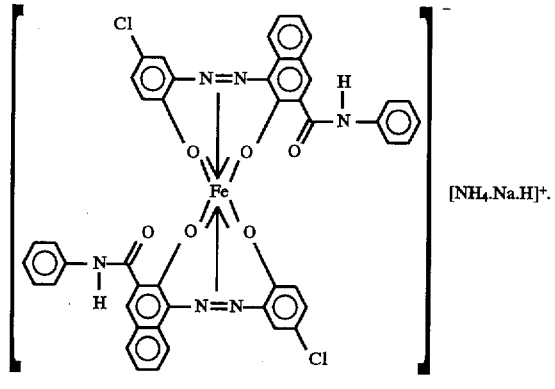

The former charge control agent is marketed by ICI/Zeneca Colours of Wilmington, Del. as CCA-7. The latter charge control agent is marketed by Hodogaya Chemical Co., Ltd. of Toyko, Japan as T-77-M.

An optional component of the toner is colorant: a pigment or dye. Stable dyes and pigments are disclosed, for example, in U.S. Reissue Pat. No. 31,072 and in U.S. Pat. Nos. 4,160,644; 4,416,965; 4,414,152; and 2,229,513. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent.

The toner can also contain other additives of the type used in previous toners, including leveling agents, surfactors, stabilizers, and the like. The total quantity of such additives can vary. A present preference is to employ not more than about 10 weight percent of such additives on a total toner powder composition weight basis.

Suitable dry styrenic/acrylic copolymer toners can optionally incorporate a small quantity of low surface energy material in combination with toner particles comprised of polyester polymer, as described in U.S. Pat. Nos. 4,517,272 and 4,758,491. Optionally the toner can contain a particulate additive on its surface such as the particulate additive disclosed in U.S. Pat. No. 5,192,697.

The charge control agent and other addends can be added to the toner in a number of ways. For example, in a dry electrostatographic toner, the charge control agent can be mix-blending in the manner described in U.S. Pat. Nos. 4,684,596 and 4,394,430, with an appropriate polymeric binder material and any other desired addenda. The mixture is then ground to desired particle size to form a free-flowing powder of toner particles containing the charge agent. A performed mechanical blend of particulate polymer particles, charge control agent, colorants and additives can, alternatively, be roll milled or extruded at a temperature sufficient to melt blend the polymer or mixture of polymers to achieve a uniformly blended composition. The resulting material, after cooling, can be ground and classified, if desired, to achieve a desired toner powder size and size distribution. For a polymer having a $T_g$ in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes. After melt blending and cooling, the composition can be stored before being ground. Grinding can be carried out by any convenient procedure. For example, the solid composition can be crushed and then ground using, for example, a fluid energy or jet mill, such as described in U.S. Pat. No. 4,089,472. Classification can be accomplished using one or two steps.

In place of mix or melt blending, the polymer can be dissolved in a solvent in which the charge control agent and other additives are also dissolved or are dispersed. The resulting solution can be spray dried to produce particulate toner powders. Limited coalescence polymer suspension procedures as disclosed in U.S. Pat. No. 4,833,060 are particularly useful for producing small sized, uniform toner particles.

The toner and developer of the invention can be used in a variety of ways to develop electrostatic charge patterns or latent images. Such developable charge patterns can be prepared by a number of means can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After image-wise deposition of the toner particles the image can be fixed, for example, by heating the toner to cause it to fuse to the substrate carrying the toner. If desired, the unfused image can be transferred to a receiver such as a blank sheet of copy paper and then fused to form a permanent image.

The following Examples and Comparative Examples are presented to further illustrate and clarify the invention and to compare the triboelectric properties of inventive carrier particles produced by the inventive method to those properties of similar carrier particles not treated in accordance with the invention.

Unless otherwise indicated, all starting materials were commercially obtained. Styrene-co-butylacrylate-co-divinyl benzene binder polymer was produced in accordance with the method described in U.S. Pat. No. 4,833,060.

EXAMPLES

The following procedures were used in all of the following examples to prepare carrier particles, toners and developers and evaluate charging and throwoff (T.O.).

(1) Preparation of Untreated Coated Carrier Particles

Untreated, coated carrier particles were prepared by mixing 0.5 grams of 0.3 micrometer (1)poly(vinylidene fluoride) powder marketed by Pennwalt Corp. as Kynar 301F, or (2) styrene/methyl methacrylate copolymer 80/20 (Soken MP-2029 with 100 grams of bare (uncoated) strontium ferrite core particles. The mixture was placed in a bottle and rolled on a roll mill for 1 hour to thoroughly disperse the polymer over the surface of the carrier. The mixture was then cured at 230° C. for 2.5 hours to fuse the polymer to the surface of the particles. The volume average particle size of the carrier particles was from about 25 to 35 micrometers.

Kynar coated carrier particles were further treated with a 15% acid wash (12% acetic acid and 4% nitric acid) for 2 hours and water washed as taught in U.S. Pat. No. 5,100,754. The purpose of this treatment was to reduce the amount of soluble strontium and iron on the Kynar coated carrier particle surfaces. This insures that evaluation results are due to the formation of deposits on the surface of the carrier according to the method of the present invention.

(2) Treatment of Carrier Particles Surface

Distilled water (150 mL), KOH (6 grams) and 6 grams of oxidizing agent were combined in a 500 mL three-neck flask. The flask was fitted with a stirrer, sealed from the ambient atmosphere, and placed in a 60° C. water bath. Untreated, coated carrier (100 grams) was then added. To this was added approximately 0.1% to 2.0% metal salts (based on weight of carrier) dissolved in approximately 10 mL of distilled water. The mixture was allowed to stir for 2 hours. The resulting liquid was then filtered off and the particles were washed with 900 mL of water, six times. The particles were collected and allowed to dry at 60° C. and were then allowed to cool.

(3) Preparation of Toner

A dry blend of 100 parts per hundred (pph) of styrene-co-butylacrylate-co-divinyl benzene (77 parts:23 parts:0.3 parts) binder polymer and 2 pph of the charge control agent CCA-7 and 6 pph Regal 300ä carbon black, marketed by Cabot Corp., was added to a heated two-roll compounding mill. The roller surfaces were set to 150° C. The melt was exercised on the mill for 15 minutes, then was removed and cooled. The resulting slab was first coarse ground to 2 mm size on a laboratory mill, then finely pulverized to approximately 12 micrometer size on a Trost TX jet mill.

(4) Preparation of Developer

Developer was prepared by mixing toner particles prepared as described above at a weight concentration of 12% toner with the carrier particles.

(5) Evaluation of Toner Charging

Toner charge was measured, at 50 percent relative humidity, in microcoulombs per gram of toner (mc/g) in a "MECCA device", that is, a magnetic electrostatic charge concentration apparatus, for two "exercise" time periods, designated "3 min. Q/m" and "10 min. Q/m" in Tables 1 and 2. Prior to measuring the toner charge, the carrier was vigorously shaken or "exercised" with toner to cause triboelectric charging by placing a 4 gram sample of developer (3.52 g magnetized carrier, 0.48 g toner) into a 4 dram glass screw cap vial, capping the vial and shaking the vial on a "wrist-action" robot shaker operated at about 2 Hertz and an overall amplitude of about 11 cm for 3 minutes. Toner charge level after shaking was then measured by placing a 100 milligram sample of the charged developer in a MECCA apparatus and measuring the charge and mass of transferred toner in the MECCA apparatus. This involves placing the 100 milligram sample of the charged developer in a sample dish between electrode plates. The sample is subjected for 30 seconds, simultaneously to a 60 Hz magnetic field and to an electric field of about 2000 volts/cm between the plates. The magnetic field causes the developer to agitate. The toner is released from the carrier and is attracted to and collects on the plate having polarity opposite to the toner charge. The total toner charge is measured by an electrometer connected to the plate, and that value is divided by the weight of the toner on the plate to yield the charge per mass of toner (Q/m). This measurement represents "3 min Q/m".

The toner charge level (i.e., charge-to-mass ratio) was also taken after exercising the developer for an additional 10 minutes by placing the magnetized developer in a glass bottle on top of a cylindrical roll with rotating magnetic core rotating at 2000 revolutions per minute. This closely approximates typical actual usage of the developer in an electrostatographic development process. After this additional 10 minute exercising, the toner charge was measured in a MECCA apparatus. This measurement represents "10 min. Q/m".

The 3 min. and 10 min. charge levels were measured for carrier subject to three aging periods: (a) no aging, (b) 16 hours 1 "overnight", and (c) 2 "overnights"; designated "No Aging", "1 O.N.", and "2 O.N." in the tables). The 1 overnight aging was provided by exercising, the same manner as described above, a fresh sample of 6 grams of developer (5.28 g magnetized carrier, 0.72 g toner) in a 4 dram glass screw cap vial, for 16 hours. The developer was then electrically stripped in a 5.5 Kv field to remove essentially all of the exercised toner and then rebuilt with fresh toner. The 3 min. and 10 min. Q/m measurements were then taken in the same manner as above described and throw-off was measured as below described. The developer was then stripped in a 5.5 Kv field and the 1 O.N. 16 hour aging was repeated followed again by developer strip and rebuild and by 3 min. and 10 min. Q/m measurements and throw-off testing. Values are reported in Table 1.

(6) Evaluation of Throw-Off

Throw-off values (T.O.) were determined, at 50 percent relative humidity, by taking the 4 gram developer sample at 12% toner concentration that had been exercised for 10 minutes admixing in 6% more toner to provide a final toner concentration of about 18%), followed by a 15 second shake on the wrist action shaker. This developer was then placed on a roll containing a rotating magnetic core, similar to a magnetic brush roll used for electrostatic development. A plexiglass housing contained the assembly, and had a vacuum filter funnel mounted directly over the roll. The weight of toner, in milligrams, collected on a piece of filter paper after one minute of running the magnetic core at 2000 revolutions per minute was reported as the throw-off value.

EXAMPLE 1

Table 1, infra, shows the effect of subjecting acid prewashed poly(vinylidene fluoride) (Kynar K301F) coated carrier particles to the method of the invention using 16 different acidic metal salts. Sodium persulfate/potassium hydroxide (4% $Na_2S_2O_8$/4% KOH) in conjunction with acidic metal salt were used in the method. Table 1 includes controls 1 and 2. Control 1 provides a comparison between carrier particles treated according to the method with the same carrier particles that were subjected to any treatment at all. Control 2 comparison between carrier particles treated according to the method with the same carrier particles that were subjected to only treatment with base and oxidizing agent. Charging and/or throwoff (T.O.) always improved when an acidic metal salt was used in the treatment.

Certain metals such as Sr, La, Ni, and Mg were extremely potent and showed a significant charge increase as well as improved throwoff. Co, Cu, Fe, and Mn, showed little or no change in charge while still improving the throwoff.

TABLE 1

Charging and Throwoff of Acid Prewashed Poly(vinylidene fluoride) (Kynar K301F) Coated Carrier Particles Treated with Oxidizing Agent and Soluble Acidic Metal Salts

| Example No. | Treatment | Aging Cycle | Q/m 3 min. | Q/m 10 min. | T.O (mg admix) |
|---|---|---|---|---|---|
| Control 1 | None | NO AGING | −7.6 | −22.5 | 59.3 |
| | | 1-O.N. | −14.4 | −24.5 | 30 |
| | | 2-O.N. | −15.5 | −25.8 | −28.4 |
| Control 2 | 4% $Na_2S_2O_8$/KOH Only | NO AGING | −31.3 | −28.7 | 18.8 |
| | | 1-O.N. | −16.5 | −26.3 | 18.1 |
| | | 2-O.N. | −15.5 | −23.1 | 19.4 |
| 1 | 4% $Na_2S_2O_8$/KOH and 2% $SrCl_2.6H_2O$ | NO AGING | −37.2 | −47.4 | 0.4 |
| | | 1-O.N. | −21.6 | −29.8 | 3.6 |
| | | 2-O.N. | −21.2 | −24.3 | 8 |
| 3 | 4% $Na_2S_2O_8$/KOH and 2% $BaCl_2.2H_2O$ | NO AGING | −39.4 | −46.1 | 0.5 |
| | | 1-O.N. | −21.3 | −32.7 | 12.2 |
| | | 2-O.N. | −17.1 | −24.9 | 18.2 |
| 4 | 4% $Na_2S_2O_8$/KOH and 2%$FeCl_3.6H_2O$ | NO AGING | −27.5 | −25.2 | 0.7 |
| | | 1-O.N. | −16.5 | −22.6 | 11 |
| | | 2-O.N. | −18.1 | −24.4 | 12.9 |
| 5 | 4% $Na_2S_2O_8$/KOH and 1% $FeSO_4.7H_2O$ | NO AGING | −29.3 | −16.2 | 1 |
| | | 1-O.N. | −19.8 | −27.1 | 13.5 |
| | | 2-O.N. | −18.5 | −25.5 | 15.5 |
| 6 | 4% $Na_2S_2O_8$/KOH and | NO AGING | −52.8 | −61 | 0.1 |

TABLE 1-continued

Charging and Throwoff of Acid Prewashed Poly(vinylidene fluoride) (Kynar K301F) Coated Carrier Particles Treated with Oxidizing Agent and Soluble Acidic Metal Salts

| Example No. | Treatment | Aging Cycle | Q/m 3 min. | Q/m 10 min. | T.O (mg admix) |
|---|---|---|---|---|---|
| | 2% $LaCl_3.7H_2O$ | 1-O.N. | −25.5 | −30.8 | 2.3 |
| | | 1-O.N. | −20.1 | −29.3 | 4.7 |
| 7 | 4% $Na_2S_2O_8$/KOH and | NO AGING | −51.3 | −51.4 | 0.1 |
| | 0.5% $NiSO_4.6H_2O$ | 1-O.N. | −19.7 | −28.6 | 3.3 |
| | | 2-O.N. | −20.2 | −27.3 | 5.4 |
| 8 | 4% $Na_2S_2O_8$/KOH and | NO AGING | −35 | −21.7 | 0.8 |
| | 0.5% $CuSO_4.5H_2O$ | 1-O.N. | −17.6 | −27.7 | 5.8 |
| | | 2-O.N. | −18 | −27.7 | 9.5 |
| 9 | 4% $Na_2S_2O_8$/KOH and | NO AGING | −34.1 | −26.1 | 0.5 |
| | 0.5% $CoCl_2.6H_2O$ | 1-O.N. | −18.7 | −30 | 4.5 |
| | | 2-O.N. | −18 | −27 | 12.8 |
| 10 | 4% $Na_2S_2O_8$/KOH and | NO AGING | −50.1 | −36.5 | 0.8 |
| | 1% $MgCl_2.6H_2O$ | 1-O.N. | −21.9 | −29.2 | 2.6 |
| | | 2-O.N. | −21.7 | −29.1 | 1.8 |
| 11 | 4% $Na_2S_2O_8$/KOH and | NO AGING | −24.3 | −25.4 | 11.2 |
| | 0.5% $CaCl_2.2H_2O$ | 1-O.N. | −15.2 | −24.6 | 14.9 |
| | | 2-O.N. | −15.3 | −22.2 | 14.6 |
| 12 | 4% $Na_2S_2O_8$/KOH and | NO AGING | −33 | −38.2 | 7.4 |
| | 0.2% $MnSO_4.H_2O$ | 1-O.N. | −18.9 | −29.3 | 3.8 |
| | | 2-O.N. | −18 | −26.9 | 4.6 |
| 13 | 4% $Na_2S_2O_8$/KPH and | NO AGING | −31 | −27.8 | 6.8 |
| | 0.2% $SnSO_4$ | 1-O.N. | −15.1 | −25.1 | 12.4 |
| | | 2-O.N. | −15.7 | −22 | 12.3 |
| 14 | 4% $Na_2S_2O_8$/KOH and | NO AGING | −28.9 | −24.9 | 6.4 |
| | 2% $AlCl_3.6H_2O$ | 1-O.N. | −14.2 | −23.9 | 12.2 |
| | | 2-O.N. | −16.7 | −21.5 | 14.8 |
| 15 | 4% $Na_2S_2O_8$/KOH and | NO AGING | −27.7 | −24.8 | 6.6 |
| | 1% $CrCl_3.6H_2O$ | 1-O.N. | −17.2 | −26.9 | 10.6 |
| | | 2-O.N. | −16.9 | −24.5 | 14 |
| 16 | 4% $Na_2S_2O_8$/KOH and | NO AGING | −28.3 | −25.3 | 6.8 |
| | 0.15% $ZnSO_4.7H_2O$ | 1-O.N. | −16.6 | −26.9 | 11.5 |
| | | 2-O.N. | −18.6 | −26.6 | 12.5 |

The Addition of Metal Salts to a Bare (uncoated) Strontium Ferrite Carrier Particles Table 1, infra, shows the effect of subjecting acid prewashed poly(vinylidene fluoride) (Kynar K301F) coated carrier particles to the method of the invention using 16 different acidic metal salts.

Samples of bare ferrite core were treated with 4% KOH and 4% $Na_2S_2O_8$ to show that certain metal salts will readily form the microcrystalline deposit, resulting in improved throwoff (Admix Dust), without Kynar having to be present. Strontium will not readily form microcrystalline deposits under these conditions as it requires a source of carbonate anion to form strontium carbonate. Salts of metals such as Mg, Fe, La, and Cu will work merely in the presence of base as they readily form a hydroxide or hydrated oxides under basic conditions.

EXAMPLE 2

Table 2, infra, shows the effect of subjecting a uncoated carrier particles to the method of the invention using 5 different acidic metal salts. Table 2 includes controls 1 and 2. Control 1 provides a comparison between carrier particles treated according to the method with the same carrier particles that were not subjected to any treatment at all. Control 2 presents a comparison between carrier particles treated according to the method with the same carrier particles that were subjected to only treatment with base and oxidizing agent. Charging and/or throwoff (T.O.) always improved when an acidic metal salt was used in the treatment. Strontium showed little effect. Cu salts were interesting because they showed not only a reduction in throwoff but also can be used to lower the charge.

TABLE 2

Uncoated Ferrite Carrier Particles Treated with Oxidizing Agent or Reducing Agent and Soluble Acidic Metal Salts

| Example No. | Treatment | Aging Cycle | Q/m 3 min. | Q/m 10 min. | T.O (mg admix) |
|---|---|---|---|---|---|
| Control 1 | None | NO AGING | −50.6 | −47 | 2.1 |
| | | 1-O.N. | −22.4 | −31.7 | 7.9 |
| | | 2-O.N. | −16.8 | −24.1 | 27.9 |
| Control 2 | 4% $Na_2S_2O_8$/4% KOH | NO AGING | −47.4 | −44.6 | 1.9 |
| | | 1-O.N. | −20.7 | −29.6 | 6.4 |
| | | 2-O.N. | −18.3 | −25.4 | 25.5 |
| 1 | 4% $Na_2S_2O_8$/4% KOH | NO AGING | −47.5 | −51.1 | 0.2 |
| | and | 1-O.N. | −29.3 | −30.2 | 2.2 |

TABLE 2-continued

Uncoated Ferrite Carrier Particles Treated with Oxidizing Agent or Reducing Agent and Soluble Acidic Metal Salts

| Example No. | Treatment | Aging Cycle | Q/m 3 min. | Q/m 10 min. | T.O (mg admix) |
|---|---|---|---|---|---|
| | 2% $NiSO_4.6H_2O$ | 2-O.N. | −22.6 | −26.7 | 5.5 |
| 2 | 4% $Na_2S_2O_8$/4% KOH | NO AGING | −50.1 | −46.6 | 1.8 |
| | and | 1-O.N. | −22.5 | −29 | 7.6 |
| | 2% $SrCl_2.6H_2O$ | 2-O.N. | −18.3 | −24.8 | 27.9 |
| 3 | 4% $Na_2S_2O_8$/4% KOH | NO AGING | −56.7 | −41.7 | 0.2 |
| | and | 1-O.N. | −27.3 | −30.6 | 1.5 |
| | 1% $MgCl_2.6H_2O$ | 2-O.N. | −23.4 | −27.5 | 3.6 |
| 4 | 4% $Na_2S_2O_8$/4% KOH | NO AGING | −57.6 | −57.2 | 0.4 |
| | and | 1-O.N. | −28.9 | −31.8 | 2.8 |
| | 2% $LaCl_3.7H_2O$ | 20O.N. | −26.5 | −31.6 | 3.5 |
| 5 | 4% $Na_2S_2O_8$/4% KOH | NO AGING | −21 | −27.4 | 1.1 |
| | and | 1-O.N. | −23.4 | −30.2 | 7.2 |
| | 2% $CuSO_4.5H_2O$ | 2-O.N. | −20.8 | −29 | 12.2 |

EXAMPLE 3

Table 3, infra, shows the effect of subjecting styrene/methylmethacrylate copolymer coated carrier particles to the method of the invention using 2 different acidic metal salts. Table 3 includes controls 1 and 2. Control 1 provides a comparison between carrier particles treated according to the method with the same carrier particles that were not subjected to any treatment at all. Control 2 presents a comparison between carrier particles treated according to the method with the same carrier particles that were subjected to only treatment with base and oxidizing agent. Charging and/or throwoff (T.O.) always improved when an acidic metal salt was used in the treatment. The 1% $MgCl_2.6H_2O$ embodiment showed an increase in throwoff in the absence of aging. This increase was essentially eliminated through preconditioning. Preconditioning is an exercising of the carrier particle either mechanically or through magnetic agitation. Certain metal derivatives can actually poison the system if present in too high a concentration, therefore the concentration has to be adjusted accordingly. This is a balancing act in that too much and the throwoff increases; too little and the developer life is only slightly improved. This is shown in the 0.25% and 1% Mg $Cl_2.6H_2O$ samples. Preconditioning the 1% sample, removes the loose crystallites from the exposed surfaces and packs them into the pores; thus the reason for the improved throwoff on the 20 min. bottle brush (B.B.) preconditioned sample.

TABLE 3

Charging and Throwoff of Styrene/Methyacrylate Copolymer (Soken MP-2029) Coated Carrier Particles Treated with Oxidizing Agent and Soluble Acidic Metal Salts

| Example No. | Treatment | Aging Cycle | Q/m 3 min. | Q/m 10 min. | T.O (mg admix) |
|---|---|---|---|---|---|
| Control | None | NO AGING | −20.1 | −22.5 | 19.8 |
| | | 1-O.N. | −15.5 | −22.8 | 22.6 |
| | | 2-O.N. | −15.3 | −22 | 52.9 |
| Control 2 | 4% $Na_2S_2O_8$/4% KOH | NO AGING | −33 | −23.1 | 6.5 |
| | only | 1-O.N. | −16.9 | −24.9 | 15.3 |
| | | 2-O.N. | −16.2 | −22.5 | 43.2 |
| 1 | 4% $Na_2S_2O_8$/4% KOH | NO AGING | −37.7 | −29.4 | 1.2 |
| | and | 1-O.N. | −23.7 | −29 | 5.1 |
| | 1% $LaCl_3.7H_2O$ | 2-O.N. | −23 | −30.8 | 8.7 |
| 2 | 4% $Na_2S_2O_8$/4% KOH | NO AGING | −48.4 | −19.7 | 75.7 |
| | and | 1-O.N. | −23.6 | −25.9 | 2.1 |
| | 1% $MgCl_2.6H_2O$ | 2-O.N | −20.8 | −26.7 | 3.5 |
| 3 | 4% $Na_2S_2O_8$/4% KOH | NO AGING | −50.2 | −35 | 0.2 |
| | and | 1-O.N. | −19.1 | −26.6 | 3.2 |
| | 0.25% $MgCl_2.6H_2O$ | 2-O.N. | −17.1 | −24.9 | 20.4 |
| 4 | 4% $Na_2S_2O_8$/4% KOH | NO AGING | −40.3 | −33.3 | 0.4 |
| | and | 1-O.N. | −25.4 | −28.1 | 1.3 |
| | 1% $MgCl_2.6H_2O$* | 2-O.N. | −21.6 | −27.8 | 2.6 |

*after bottle brush 20 min. preconditioning

The invention has been described in detail with particular reference to preferred embodiments thereof, but it will be understood that variations and modifications can be effected within the spirit and scope of the invention.

I claim:

1. Carrier particles for use in negative electrostatographic developers wherein said particles bear, based on the weight of the carrier particles, from 0.1 to 2 weight percent of deposits selected from the group consisting of (a) strontium carbonate, (b) insoluble metal hydroxides, (c) an insoluble metal hydrated oxide, and (d) mixtures thereof; provided that when the said carrier particles bear a polymeric fluro-carbon coating the deposit is other than strontium carbonate.

2. The carrier particles of claim 1 wherein said carrier particles are free of any polymeric coating.

3. The carrier particles of claim 1 wherein said particles also bears a polymeric coating.

4. The carrier particles of claim 3 wherein the polymeric coating is selected from the group consisting of silicone resins, poly(vinylidene fluoride), poly(vinylidene fluoride-co-tetrafluoroethylene), poly(methylmethacrylate) and poly (styrene-co-methylmethacrylate).

5. The carrier particles of any one of claims 1–4 wherein the metal portion of the deposit is selected from the group consisting of $Sr^{+2}$, $Ba^{+2}$, $Fe^{+3}$, $La^{+3}$, $Ni^{+2}$, $Cu^{+2}$, $Co^{+2}$, $Mg^{+2}$, $Ca^{+2}$, $Mn^{+2}$, $Sn^{+2}$, $Al^{+3}$, $Cr^{+3}$, and $Zn^{+2}$.

6. The carrier particles of claim 5 wherein the metal deposit is $Sr^{+2}$, $Fe^{+3}$, $La^{+3}$, $Co^{+2}$, $Mg^{+2}$, $Al^{+3}$ and mixtures thereof.

7. A method of modifying the triboelectric charging propensity electrostatographic developer carrier particles, comprising the steps of:

(A) providing a carrier particles that is uncoated or polymer coated;

(B) mixing the carrier particles with an oxidizing agent and either (i) an aqueous basic solution or (ii) an aqueous solution containing from 0.1 to 5.0 weight percent of a soluble acidic metal salt, based on the weight of the carrier particles to form a mixture; and (C) contacting the mixture with the solution, (i) or (ii), not used in step (B) thereby causing a precipitate of an insoluble salt to deposit on the carrier particles wherein the insoluble salt is (a) strontium carbonate;

(b) insoluble metal hydroxides;

(c) insoluble metal hydrated oxides; or (d) a mixture of two or more of (a), (b) and (c).

8. The method of claim 7 wherein said carrier particles are free of any polymeric coating.

9. The method of claim 7 wherein said particles also bear a polymeric coating.

10. The method of claim 9 wherein the polymeric coating is selected from the group consisting of silicone resins, poly(vinylidene fluoride), poly(vinylidene fluoride-co-tetrafluoroethylene), poly(methymethacrylate) and poly (styrene-co-methylmethacrylate).

11. The method of any one of claims 8–10 wherein the acidic metal salt comprises a metal selected from the group consisting of $Sr^{+2}$, $Ba^{+2}$, $Fe^{+3}$, $La^{+3}$, $Ni^{+2}$, $Cu^{+2}$, $Co^{+2}$, $Mg^{+2}$, $Ca^{+2}$, $Mn^{+2}$, $Sn^{+2}$, $Al^{+3}$, $Cr^{+3}$, and $Zn^{+2}$.

12. The method of claim 8 wherein the carrier particles are filtered and dried.

13. The method of claim 8 wherein the oxidizing agent is sodium persulfate.

14. A negative electrostatographic developer composition comprising toners and carrier particles bearing deposits selected from the group consisting of (a) strontium carbonate, (b) insoluble metal hydroxides, (c) insoluble metal hydrated oxides or (d) mixtures thereof; provided that when the said carrier particles bear a polymeric flurocarbon coating the deposit is other than strontium carbonate.

* * * * *